US009097110B2

(12) United States Patent
Kaminsky et al.

(10) Patent No.: US 9,097,110 B2
(45) Date of Patent: Aug. 4, 2015

(54) VISCOUS OIL RECOVERY USING A FLUCTUATING ELECTRIC POWER SOURCE AND A FIRED HEATER

(75) Inventors: Robert D. Kaminsky, Houston, TX (US); Robert Chick Wattenbarger, Houston, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 965 days.

(21) Appl. No.: 13/272,810

(22) Filed: Oct. 13, 2011

(65) Prior Publication Data

US 2012/0138293 A1 Jun. 7, 2012

Related U.S. Application Data

(60) Provisional application No. 61/419,564, filed on Dec. 3, 2010.

(51) Int. Cl.
*E21B 43/24* (2006.01)

(52) U.S. Cl.
CPC ..... *E21B 43/24* (2013.01)

(58) Field of Classification Search
None
See application file for complete search history.

(56) References Cited

U.S. PATENT DOCUMENTS

| | | | | |
|---|---|---|---|---|
| 1,791,797 | A | 2/1931 | Clark | |
| 4,249,605 | A * | 2/1981 | Slater et al. | 166/266 |
| 4,409,090 | A * | 10/1983 | Hanson et al. | 208/390 |
| 5,407,009 | A | 4/1995 | Butler et al. | |
| 5,628,183 | A * | 5/1997 | Rice | 60/39.182 |
| 6,205,289 | B1 * | 3/2001 | Kobro | 392/303 |
| 6,662,872 | B2 | 12/2003 | Gutek et al. | |
| 6,883,607 | B2 | 4/2005 | Nenniger et al. | |
| 6,964,300 | B2 | 11/2005 | Vinegar et al. | |
| 7,484,561 | B2 | 2/2009 | Bridges | |
| 2003/0079877 | A1 * | 5/2003 | Wellington et al. | 166/272.1 |
| 2003/0100451 | A1 * | 5/2003 | Messier et al. | 507/100 |
| 2005/0072567 | A1 * | 4/2005 | Steele et al. | 166/272.3 |
| 2007/0095536 | A1 * | 5/2007 | Vinegar et al. | 166/302 |
| 2007/0193744 | A1 * | 8/2007 | Bridges | 166/272.1 |
| 2007/0209365 | A1 * | 9/2007 | Hamer et al. | 60/648 |
| 2010/0154395 | A1 * | 6/2010 | Frick | 60/320 |
| 2010/0155062 | A1 | 6/2010 | Boone et al. | |
| 2010/0282460 | A1 | 11/2010 | Stone et al. | |
| 2013/0125842 | A1 * | 5/2013 | Frick | 122/7 R |

* cited by examiner

*Primary Examiner* — Angela M DiTrani
*Assistant Examiner* — Anuradha Ahuja
(74) *Attorney, Agent, or Firm* — ExxonMobil Upstream Research-Law Department

(57) ABSTRACT

Methods for recovering viscous oil include receiving electrical power from an electrical grid fed by at least one fluctuating electricity supply. The methods also include using at least a portion of the received electrical power to heat a first fluid stream using an electrical heater. The methods also include heating a second fluid stream with a fired-heater using a combustible fuel. The methods further include using both the first and second heated fluid streams to aid oil recovery. In accordance with these methods, the heat output of the electrical heater is adjusted during production operations to at least partially match an estimated mismatch between electrical power supply from and demand on the grid. At the same time, the heat output of the fired-heater is adjusted to at least partially compensate for fluctuations in the electrical heater heat output.

9 Claims, 7 Drawing Sheets

VISCOUS OIL RECOVERY USING A FLUCTUATING ELECTRIC POWER SOURCE AND A FIRED HEATER

CROSS-REFERENCE TO RELATED APPLICATION

This application claims the priority benefit of U.S. Provisional Patent Application 61/419,564 filed Dec. 3, 2010 entitled Viscous Oil Recovery Using a Fluctuating Electric Power Source and a Fired Heater, the entirety of which is incorporated by reference herein.

BACKGROUND

1. Field

The present invention relates to the field of hydrocarbon recovery from earth formations. More specifically, the present invention relates to the recovery of viscous hydrocarbons such as bitumen. In addition, the present invention relates to the use of excess power supplies for the generation of steam (or hot water), which may then be contacted with hydrocarbon-containing earth as part of an oil recovery operation in a subsurface formation, or in a bitumen separation facility associated with a mining operation.

2. Discussion of Technology

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

A growing demand exists for electricity generated from renewable resources. Such resources include wind and solar energy. Use of such renewable resources for generating electricity releases less emissions than the combustion of fossil fuels.

A drawback to the use of certain renewable resources, such as wind and solar energy, is the inherent fluctuation in the amounts of electrical power they can generate. In this respect, neither wind currents nor solar rays are constant. The fluctuations reflect seasonal, daily, and even hourly variations in wind and solar illumination.

Typically, an electrical power grid connecting one or more power sources to multiple users is ill-suited to accept significant amounts of fluctuating power. The primary reason is that at every instant, the total amount of electricity being fed into a power grid must essentially match the demand from that grid (plus transmission or "line" losses). A power grid does not act as a capacitor, and generally has minimal ability to store electrical power when it is in excess, or to release electrical power when it is in short supply.

One method for dealing with fluctuating power input is to offset such fluctuations with a separate power source that can be rapidly turned on, turned off, or adjusted. Such separate power sources may include hydroelectric power generators or gas turbines. However, having such generators and turbines tends to be economically inefficient since significant amounts of costly power generation equipment may sit idle at times or at least be run well below capacity. Another way to deal with fluctuating power is to store energy when it is in excess, and release energy when it is in short supply. Various methods have been proposed for large-scale energy storage. These include, for example, water-lifting, air compression, massive batteries, and hydrogen generation and storage. However, such methods tend to have relatively limited storage capacities and can be costly to implement.

Normally unrelated to the problem of power-matching is the production of viscous hydrocarbons. The term "hydrocarbons" generally refers to any organic material with molecular structures containing carbon bonded to hydrogen. Viscous hydrocarbons refers to those hydrocarbons that reside in a highly viscous or even solid (non-fluid) form. Such hydrocarbons may generally be referred to as "heavy hydrocarbons" and "solid hydrocarbons," respectively.

Heavy hydrocarbons include hydrocarbons that are highly viscous at ambient conditions (15°-25° C. and 1 atm pressure). These include bitumen, asphalt, natural mineral waxes, and so-called heavy oil. "Solid hydrocarbons" refers to any hydrocarbon material that is found naturally in substantially solid form at formation conditions. Examples include kerogen, coal, shungites, and asphaltites.

The viscosity of heavy hydrocarbons is generally greater than about 100 centipoise at 15° C. Bitumen and heavy oil are sometimes together referred to as viscous oils. Heavy hydrocarbons may also be classified by API gravity, and generally have an API gravity below about 20 degrees. Heavy oil, for example, generally has an API gravity of about 10 to 20 degrees, whereas tar generally has an API gravity below about 10 degrees.

The terms "bitumen" and "tar" are sometimes used interchangeably. Both materials are highly viscous, black, and sticky substances. However, the naturally occurring tar in subsurface formations is technically bitumen. Bitumen is a non-crystalline, highly viscous hydrocarbon material that is substantially soluble in carbon disulfide. Bitumen includes highly condensed polycyclic aromatic hydrocarbons, and is commonly used for paving roads.

Viscous oil deposits are located in various regions of the world. For example, viscous oils have been found in abundance in the Milne Point Field on the North Slope of Alaska. Viscous hydrocarbons also exist in the Jobo region of Venezuela, and have been found in the Edna and Sisquoc regions in California. In addition, extensive formations of oil sands exist in northern Alberta, Canada. These formations are sometimes referred to as "tar sands," though they technically contain bitumen.

The Athabasca oil sands deposit in northern Alberta is one of the largest viscous oil deposits in the world. There are also sizable oil sands deposits on Melville Island in the Canadian Arctic, and two smaller deposits in northern Alberta near Cold Lake and Peace River. The oil sands contain substantial amounts of bitumen.

The extraction of viscous oil deposits is oftentimes carried out through the injection of or contacting with heated fluids. For example, heavy oil deposits in California are produced by injecting hot water or steam. Heated fluids mobilize heavy hydrocarbons and separate them from the rock matrix in situ. The heated fluid may be steam. Alternatively, the heated fluid may be a solvent vapor or a steam-solvent mixture. For mined bitumen deposits, the mined oil containing earth may be contacted with heated water and/or solvent to encourage separation of bitumen from the earth solids.

The process of heating water and solvent for subsurface operations requires a great deal of energy. In this respect, large quantities of fluid must be heated to very high temperatures in order to mobilize viscous hydrocarbons. Therefore, a need exists for improved methods of stabilizing electrical power grids tied to fluctuating power sources, such as wind and solar power. Moreover, a need exists to obtain economic advantage from fluctuating power sources by using excess power from an electrical power plant to support the production of viscous hydrocarbons, such as in an enhanced oil recovery operation or in a bitumen separation facility.

SUMMARY

The methods described herein have various benefits in the conducting of oil and gas production activities in formations having oil sands or other viscous oil deposits. The viscous oil may be, for example, bitumen.

Method are provided for recovering oil from a viscous subterranean oil reservoir. In some implementations, the methods include receiving electrical power from an electrical grid. The electrical grid may be a local power grid or a regional power grid. The power grid is fed by at least one fluctuating electricity supply. The fluctuating electricity supply may be, for example, from solar electricity generation, from wind electricity generation, or both.

The methods also include using at least a portion of the received electrical power to heat a first fluid stream. The first fluid stream is heated using an electrical heater, or electrical heating unit. The electrical heater may employ, for example, resistive heating elements or conductive coils.

The methods also include heating a second fluid stream. The second fluid stream is heated with a fired-heater. The fired heater uses a combustible fuel such as oil, gas, or coal. Fuel sources for the fired-heater may include gas pipelines or hydrocarbon liquid storage tanks.

The methods further include injecting the heated first fluid stream, the heated second fluid stream, and mixtures thereof over time Optionally, at least a portion of the first and second fluid streams are mixed at the surface or in a heat injection well prior to reaching the reservoir. In some embodiments, the first fluid stream and the second fluid stream are the same physical stream. The heated first and second fluid streams are injected into the subterranean reservoir to aid oil recovery. As the heated fluid streams contact the rock matrix or ore making up the oil reservoir, the viscous hydrocarbons are mobilized in situ.

The methods also include producing oil from the subterranean reservoir. Additional production fluids may also be recovered, such as gas and water.

In accordance with these methods, the heat output of the electrical heater is adjusted during production operations. Specifically, the heat output is adjusted to at least partially correspond with an estimated excess power supply on the electrical grid. At the same time, the heat output of the fired-heater is adjusted to at least partially compensate for fluctuations in the electrical heater heat output. Thus, when excess power supply is not available, or is available in only limited amounts, the fired-heater provides greater heat output. Use of a fired-heater in this manner provides flexibility to compensate for variations in power from the electrical grid. In this respect, the electrical grid has minimal capability to store electricity, while fuel sources for fired-heaters are generally quite tolerant of demand variations.

In one aspect, adjusting the electrical heater heat output and adjusting the fired-heater heat output together generate a desired temperature or, more broadly, a desired enthalpy state, for a mixture of the first and second heated fluid streams. It is understood that "enthalpy state" covers both temperature and vaporization fraction. In this embodiment, the first and second fluid streams may be directed into a common heating vessel. The heating vessel will have separate heat exchange elements such as hot tubes that provide heat from the electrical heater and from the fired-heater, respectively.

In some embodiments, the electrical heater heat output and the fired-heater heat output is each adjusted to maintain a targeted heat transfer rate to the viscous oil reservoir. In some embodiments, the flow rate of the first fluid stream, the second fluid stream, or both are adjusted to maintain a targeted heat transfer rate to the viscous oil reservoir.

If separate heating vessels are employed, the volume of fluid injected from the first fluid stream and from the second fluid stream will vary depending on the heat output from their respective heaters. Thus, when there is no excess power supply, or little excess electrical power available, less of the first fluid stream is injected into the reservoir, and more of the second fluid stream is injected. Reciprocally, when there is abundant excess power supply, more of the first fluid stream is injected into the reservoir, and less of the second fluid stream is injected.

In some implementations, the first fluid stream, the second fluid stream, or both comprises water. More preferably, the first fluid stream, the second fluid stream, or both comprises water that is vaporized through heating into steam. Preferably, the first and second fluid streams have substantially the same fluid composition.

Additionally or alternatively, in other implementations, the first fluid stream, the second fluid stream, or both comprises a hydrocarbon solvent. The solvent may optionally be co-injected with aqueous fluid streams. Alternatively, solvent may be injected into the reservoir separate from but simultaneously with the first and second heated fluid streams.

Still additionally or alternatively, the first fluid stream, the second fluid stream, or both may comprise an asphaltic fluid. The asphaltic fluid may comprise heavy-ends produced from a solvent de-asphalting process of a viscous oil, e.g., contacting the viscous oil with propane in a vessel to cause precipitation of asphaltic components. If a market does not exist for these heavy-ends, the asphaltic fluid may be heated to reduce its viscosity and sequestered in a subsurface formation. Such a sequestering activity may reduce the lifecycle $CO_2$ generation of viscous oil production and ultimate use.

In some arrangements, the methods may further comprise receiving data from the at least one fluctuating electricity supply over a communication system, and then determining an estimate of power imbalance. In response to the received data, the electrical heater heat output is adjusted using a control system. The methods may also include determining periods of time for an anticipated excess power supply. Optionally, the operator may choose to negotiate a reduced energy cost for periods of excess electrical generation capacity.

Methods of separating bitumen from sands in a surface facility are also provided herein. The methods also involve an adjustment of heat output based on the availability of excess power supply from a power grid.

In some implementations, the methods include receiving electrical power from an electrical grid. The electrical grid may be a local power grid or a regional power grid. The power grid is fed by at least one fluctuating electricity supply. The fluctuating electricity supply may be from solar electricity generation, from wind electricity generation, or both.

The methods also include using at least a portion of the received electrical power to heat a first fluid stream. The first fluid stream is heated using an electrical heater, or electrical heating unit. The electrical heater may employ, for example, resistive heating elements or conductive coils.

The methods also include heating a second fluid stream. The second fluid stream is heated with a fired-heater. The fired heater uses a combustible fuel such as oil, gas, or coal.

The methods further include contacting in the surface facility the heated first fluid stream, the heated second fluid stream, or mixtures thereof over time with sands containing bitumen. Optionally, at least a portion of the first and second fluid streams are mixed prior to contacting the sands. The bitumen is then separated from the sands using any known separation technique. Such techniques may involve gravity separation, centrifugal separation, heating, filtering, or combinations thereof. The separated hydrocarbonaceous material is then captured for further processing and sale.

The methods also include adjusting the heat output of the electrical heater. The heat output is adjusted to at least partially correspond with an estimated excess power supply on the electrical grid. At the same time, the heat output of the fired-heater is adjusted to at least partially compensate for fluctuations in the electrical heater heat output. Thus, when excess power supply is not available, or is available in only limited amounts, the fired-heater provides greater heat output.

In some aspects, adjusting the electrical heater heat output and adjusting the fired-heater heat output together generate a desired temperature for a mixture of the first and second heated fluid stream. The volume of fluid injected from the first fluid stream and from the second fluid streams will vary depending on the heat output from their respective heaters. Thus, when there is no excess power supply, or little excess electrical power available, less of the first fluid stream is injected into the reservoir, and more of the second fluid stream is injected. Reciprocally, when there is abundant excess power supply, more of the first fluid stream is injected into the reservoir, and less of the second fluid stream is injected.

In some implementations, the first fluid stream, the second fluid stream, or both comprises water. Preferably, the first and second fluid streams have substantially the same fluid composition.

Additionally or alternatively, the first fluid stream, the second fluid stream, or both comprises a hydrocarbon solvent. The solvent may be mixed with an aqueous fluid stream. Alternatively, solvent may be injected into a slurry contactor separate from but simultaneously with the first and second heated fluid streams.

BRIEF DESCRIPTION OF THE DRAWINGS

So that the present inventions can be better understood, certain illustrations and flow charts are appended hereto. It is to be noted, however, that the drawings illustrate only selected embodiments of the inventions and are therefore not to be considered limiting of scope, for the inventions may admit to other equally effective embodiments and applications.

DETAILED DESCRIPTION OF CERTAIN EMBODIMENTS

Definitions

Figure 1:
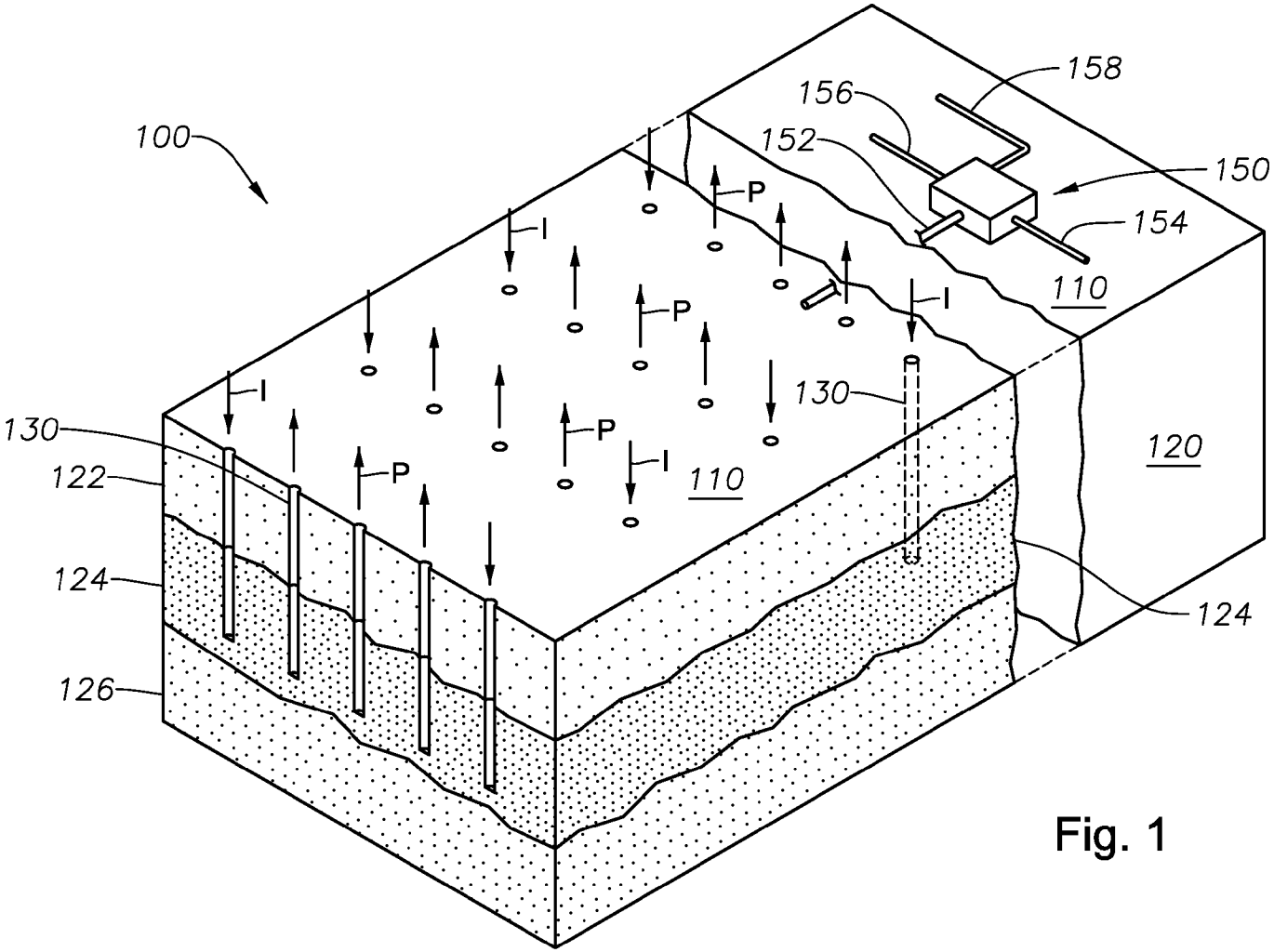
FIG. 1 is a cross-sectional perspective view of a hydrocarbon development area. The development area includes a subterranean viscous oil reservoir that is undergoing enhanced oil recovery operations.

As used herein, the term "hydrocarbon" refers to an organic compound that includes primarily, if not exclusively, the elements hydrogen and carbon. Hydrocarbons may also include other elements, such as, but not limited to, halogens, metallic elements, nitrogen, oxygen, and/or sulfur. Hydrocarbons generally fall into two classes: aliphatic, or straight chain hydrocarbons, and cyclic, or closed ring hydrocarbons, including cyclic terpenes. Examples of hydrocarbon-containing materials include any form of natural gas, oil, coal, and bitumen.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions or at ambient conditions (15° C. and 1 atm pressure). Hydrocarbon fluids may include, for example, oil, natural gas, coalbed methane, shale oil, pyrolysis oil, pyrolysis gas, a pyrolysis product of coal, and other hydrocarbons that are in a gaseous or liquid state.

The term "viscous hydrocarbon" refers to a hydrocarbon material residing in a subsurface formation that is in a generally non-flowable condition. Viscous hydrocarbons have a viscosity that is generally greater than about 100 centipoise at 15° C. A non-limiting example is bitumen.

As used herein, the term "heavy oil" refers to relatively high viscosity and high density hydrocarbons, such as bitumen. Gas-free heavy oil generally has a viscosity of greater than 100 centipoise and a density of less than 20 degrees API gravity (greater than about 900 kilograms/cubic meter under standard ambient conditions). Heavy oil may include carbon and hydrogen, as well as smaller concentrations of sulfur, oxygen, and nitrogen. Heavy oil may also include aromatics or other complex ring hydrocarbons.

As used herein, the term "tar" refers to a viscous hydrocarbon that generally has a viscosity greater than about 10,000 centipoise at 15° C. The specific gravity of tar generally is greater than 1,000. Tar may have an API gravity less than 10 degrees. "Tar sands" refers to a formation that has tar or bitumen in it.

As used herein, the term "bitumen" refers to a non-crystalline solid or viscous hydrocarbon material that is substantially soluble in carbon disulfide.

As used herein, the terms "subsurface" and "subterranean" refer to geologic strata occurring below the earth's surface.

The terms "zone" or "subterranean zone" refer to a selected portion of a formation. The formation may or may not contain hydrocarbons or formation water.

As used herein, the term "subsurface formation" means any definable subsurface region. The formation may contain one or more hydrocarbon-containing layers, one or more non-hydrocarbon containing layers, an overburden, and/or an underburden of any geologic formation. An "overburden" and/or an "underburden" is geological material above or below the formation of interest. An overburden or underburden may include one or more different types of substantially impermeable materials. For example, overburden and/or underburden may include rock, shale, mudstone, or wet/tight carbonate (i.e., an impermeable carbonate without hydrocarbons). In some cases, the overburden and/or underburden may be permeable.

An "overburden" or "underburden" may include one or more different types of substantially impermeable materials. For example, overburden and/or underburden may include sandstone, shale, mudstone, or wet/tight carbonate (i.e., an impermeable carbonate without hydrocarbons). An overburden and/or an underburden may include a hydrocarbon-containing layer that is relatively impermeable. In some cases, the overburden and/or underburden may be permeable.

As used herein, the terms "produced fluids" and "production fluids" refer to liquids and/or gases removed from a subsurface formation, including, for example, an organic-rich rock formation. Produced fluids may include both hydrocarbon fluids and non-hydrocarbon fluids. Production fluids may include, but are not limited to, mobilized oil, natural gas, pyrolyzed shale oil, synthesis gas, a pyrolysis product of coal, carbon dioxide, hydrogen sulfide and water (including steam).

As used herein, the term "fluid" refers to gases, liquids, and combinations of gases and liquids, as well as to combinations of gases and solids, combinations of liquids and solids, and combinations of gases, liquids, and solids.

As used herein, the term "gas" refers to a fluid that is in its vapor phase at 1 atm and 15° C.

As used herein, the term "oil" refers to a hydrocarbon fluid containing primarily a mixture of condensable hydrocarbons.

As used herein, the term "wellbore" refers to a hole in the subsurface made by drilling or insertion of a conduit into the subsurface. A wellbore may have a substantially circular cross section, or other cross-sectional shape. As used herein, the term "well," when referring to an opening in the formation, may be used interchangeably with the term "wellbore."

The term "tubular member" refers to any pipe, such as a joint of casing, a portion of a liner, or a pup joint.

The term "power imbalance" refers to a condition where a supply of electrical power does not match a demand, thus resulting in a deviation in the voltage delivered to electricity users from an expected standard (e.g., 120V for residential users in the United States). A deficit of power supply results in a so-called "brownout," which is a condition where a delivered voltage drops below an expected value. Certain electrical equipment, especially computer equipment, may be very sensitive to brownouts. A surplus of power supply results in a so-called "surge," which is a condition where a delivered voltage exceeds an expected value. Most electrical equipment has limited tolerances to surges, even for short times. Unacceptable deviations from standard voltages may be those greater than only a few volts, e.g., 1V, 3V, or 5V, or a few percentage points off of the standard, e.g., 0.5%, 1%, or 3%.

The term "solvent" refers to any fluid that is significantly soluble with a particular liquid, resulting in a homogeneous mixture at the temperature and pressure of interest. Solubility amounts of the liquid in the solvent resulting in a homogeneous mixture may be greater than 10 mass percent. Non-limiting examples of solvents for hydrocarbon oils include propane, heptane, diesel, and kerosene.

Description of Selected Specific Embodiments

FIG. 1 provides a cross-sectional perspective view of an illustrative hydrocarbon development area 100. The hydrocarbon development area 100 has a surface 110. Preferably, the surface 110 is an earth surface on land. However, the surface 110 may be an earth surface under a body of water, such as a lake, an estuary, a bay, or an ocean.

The hydrocarbon development area 100 also has a subsurface 120. The subsurface 120 includes various formations, including one or more near-surface formations 122, a hydrocarbon-bearing formation 124, and one or more non-hydrocarbon formations 126. The near surface formations 122 represent an overburden, while the non-hydrocarbon formations 126 represent an underburden. Both the one or more near-surface formations 122 and the non-hydrocarbon formations 126 will typically have various strata with different mineralogies therein.

The hydrocarbon development area 100 is for the purpose of producing hydrocarbon fluids from the hydrocarbon-bearing formation 124. The hydrocarbon-bearing formation 124 defines a rock matrix having hydrocarbons residing therein. The hydrocarbons are viscous hydrocarbons, such as heavy oil, that do not readily flow at formation conditions. The hydrocarbon-bearing formation 124 may contain, for example, tar sands that are too deep for economical open pit mining. Therefore, an enhanced oil recovery method such as steam injection or the injection of hydrocarbon solvents is desirable.

The rock matrix making up the formation 124 may be permeable or semi-permeable. Subsurface permeability may be assessed via rock samples, outcrops, or studies of ground water flow. The present inventions are particularly advantageous in bitumen formations initially having limited viscosity. The viscous hydrocarbon may have a viscosity greater than about 1,000 cp in its undisturbed in situ state. In one aspect, the viscous hydrocarbon comprises primarily bitumen. After substantial heating, the viscous hydrocarbon may have a viscosity well below 100 cp.

In order to access the hydrocarbon-bearing formation 124 and recover natural resources therefrom, a plurality of wellbores is formed. The wellbores are shown at 130, with some wellbores 130 being seen in cut-away and one being shown in phantom. The wellbores 130 extend from the surface 110 into the formation 124.

Each of the wellbores 130 in FIG. 1 has either an up arrow or a down arrow associated with it. The up arrows indicate that the associated wellbore 130 is a production well. Some of these up arrows are indicated with a "P." The production wells "P" produce hydrocarbon fluids from the hydrocarbon-bearing formation 124 to the surface 110. Reciprocally, the down arrows indicate that the associated wellbore 130 is a heat injection well, or a heater well. Some of these down arrows are indicated with an "I." The heat injection wells "I" inject heated fluids into the hydrocarbon-bearing formation 124. Although the injection wells and production wells are illustrated as being separate, in some embodiments common wells may be used for both injection and production.

The purpose for heating the rock in the formation 124 is to mobilize viscous hydrocarbons. The rock in the formation 124 is heated to a temperature sufficient to liquefy bitumen or other heavy hydrocarbons so that they flow to a production well "P." The resulting hydrocarbon liquids and gases may be refined into products which resemble common commercial petroleum products. Such liquid products include transportation fuels such as diesel, jet fuel and naphtha. Generated gases may include light alkanes, light alkenes, $H_2$, $CO_2$, CO, and $NH_3$. For bitumen, the resulting hydrocarbon liquids may be used for road paving and surface sealing.

The fluid injected into the formation 124 through the injection wells "I" may be heated water. More preferably, the fluid comprises steam. Optionally, the fluid also comprises a hydrocarbon solvent. The hydrocarbon solvent is preferably in the $C_3$ to $C_{10}$ range. In any arrangement, the fluid is preferably injected from the surface at a temperature of at least 60° C., and more preferably at least 100° C.

In the illustrative hydrocarbon development area 100, the wellbores 130 are arranged in rows. The production wells "P" are in rows, and the heat injection wells "I" are in adjacent rows. This is referred to in the industry as a "line drive" arrangement. However, other geometric arrangements may be used such as a 5-spot arrangement. The inventions disclosed herein are not limited to the arrangement of production wells "P" and heat injection wells "I" within a particular zone unless so stated in the claims.

The various wellbores 130 are presented as having been completed substantially vertically. However, it is understood that some or all of the wellbores 130, particularly for the production wells "P," could deviate into an obtuse or even horizontal orientation.

It is understood that petroleum engineers will develop a strategy for the best completion depth and arrangement for the wellbores 130 depending upon anticipated reservoir characteristics, economic constraints, and work scheduling constraints. In addition, engineering staff will determine what injection wells "I" should be formed for formation heating. Preferably, the injection wells "I" are arranged to form a steam-assisted gravity drainage (SAGD) process. However, other recovery processes may be employed, such as steam flooding, cyclic steam flooding (e.g., steam soak), or cyclic steam stimulation (CSS). Each of these processes is known for the mobilization of hydrocarbons within viscous oil reservoirs.

In the view of FIG. 1, only eight wellbores 130 are shown for the heat injection wells "I." Likewise, only twelve wellbores 130 are shown for the production wells "P." However, it is understood that in a hydrocarbon development project, numerous additional wellbores 130 will be drilled. In addition, separate wellbores (not shown) may optionally be formed for sensing or data collection.

The production wells "P" and the heat injection wells "I" are also arranged at a pre-determined spacing. In some embodiments, a well spacing of 100 to 1,000 feet is provided for the various wellbores 130. The claims disclosed below are not limited to the spacing of the production wells "P" or the heat injection wells "I" unless otherwise stated.

A production fluids processing facility 150 is also shown schematically in FIG. 1. The processing facility 150 is designed to receive fluids produced from the formation 124 through one or more pipelines or flow lines 152. The fluid processing facility 150 may include equipment suitable for receiving and separating oil, gas, and water produced from the heated formation 124. The fluids processing facility 150 may further include equipment for separating out acid gases such as $CO_2$ and $H_2S$, and/or migratory contaminant species, including, for example, dissolved organic contaminants, metal contaminants, or ionic contaminants in the produced water recovered from the hydrocarbon-bearing formation 124.

FIG. 1 shows three exit lines 154, 156, and 158. The exit lines 154, 156, 158 carry fluids from the fluids processing facility 150. Exit line 154 carries oil; exit line 156 carries gas; and exit line 158 carries separated water. The water may be treated and, optionally, re-injected into the hydrocarbon-bearing formation 124 as steam for further enhanced oil recovery.

In order to heat the fluids that are injected into the injection wells "I," heating facilities (not shown in FIG. 1) are provided. In accordance with the methods of the present invention, two separate heating units are employed. One of the units is an electrical heater, while the other unit is a fired heater. The electrical heater draws electricity from a local or regional power grid to generate heat, while the fired heater uses a combustible fuel to generate heat.

Figure 2:
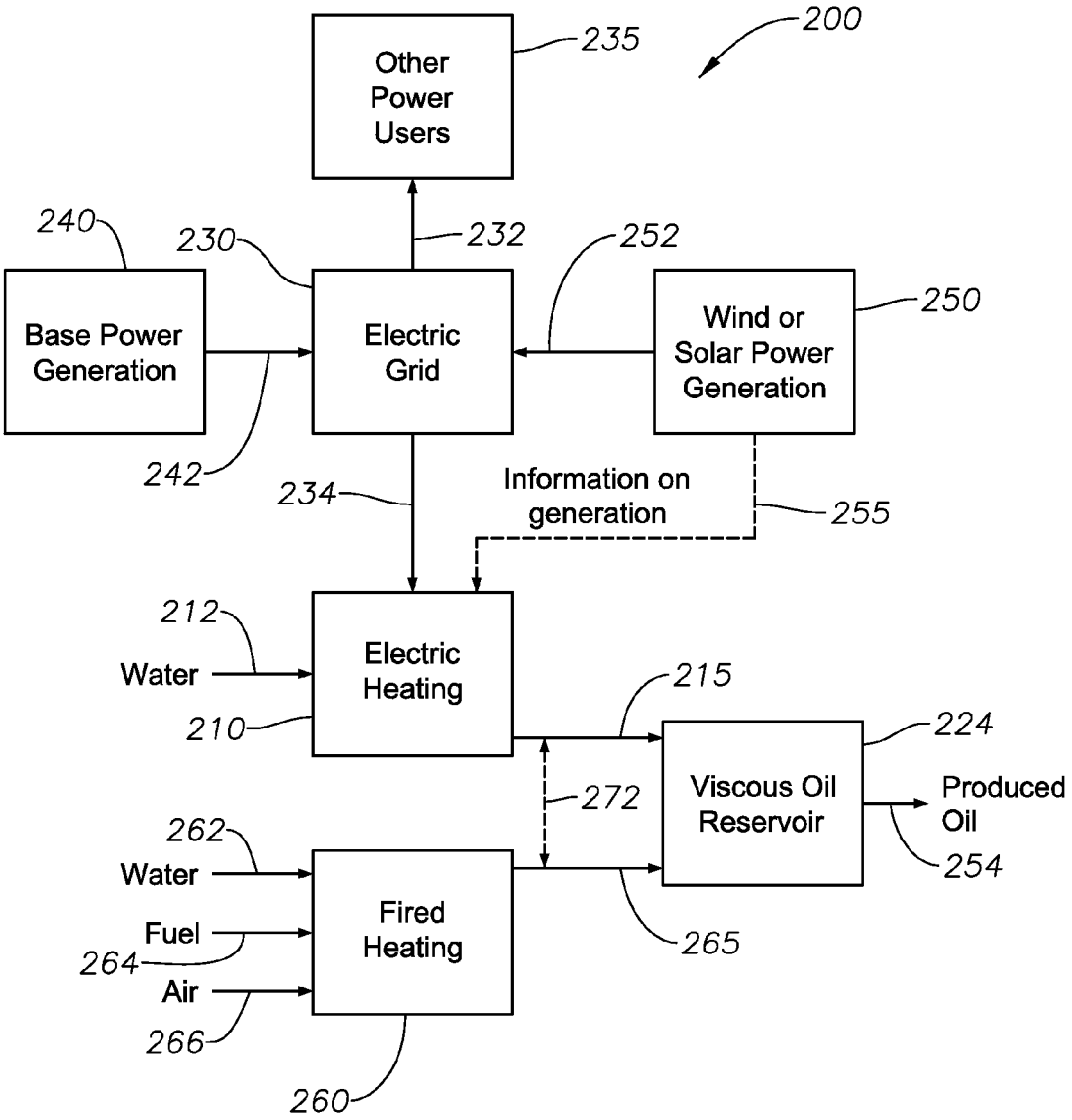
FIG. 2 is a first schematic diagram of a fluid heating facility. The fluid heating facility includes an electrical heating unit and a fired-heater heating unit. Heated fluid is being transported from the heating units into a viscous oil reservoir.

FIG. 2 provides a first schematic diagram showing a heating system 200. This heating system 200 is for a viscous oil reservoir. The viscous oil reservoir is shown at 224, and may be the same reservoir as shown at 124 in FIG. 1.

In order to mobilize hydrocarbons residing in the viscous oil reservoir 224, heated fluid is injected into the reservoir 224. Heated fluid streams are shown at lines 215 and 265. The fluid streams 215, 265 are carried through one or more pumps, or pressure boosters (not shown), and then injected into the reservoir 224. In one arrangement, the fluid streams 215, 265 are combined into common pressure vessels for pressurizing and delivery into the oil reservoir 224. In another arrangement, heated liquid from the fluid streams 215, 265 is temporarily stored in insulated surface tanks (not shown) prior to injection into the subsurface reservoir 224.

In a preferred embodiment, each fluid stream 215, 265 comprises primarily hot water. The water may be either fresh water or brine. Preferably, the water is heated at the surface to a temperature that causes the water to vaporize into pressurized steam. Higher temperatures beneficially serve to reduce the viscosity of hydrocarbons in the reservoir 224. However, either or both of the fluid streams 215, 265 may also comprise a hydrocarbon solvent to further reduce the in situ oil viscosity.

In order to heat the fluid streams 215, 265, heating units are provided. First, an electrical heater is provided at 210. The electrical heater 210 receives water, as shown at fluid in-take line 212. The electrical heater operates on electricity received via line 234 from an electric grid 230. The electrical heater 210 preferably uses resistive heating elements or conductive coils in order to heat water or other fluid. Heating of the water may take place through either direct or indirect contact with a fluid. Where direct contact is used, inorganic scale inhibitors may be added to reduce scale build-up on the elements. The heated fluid from the electrical heater 210 becomes the first fluid stream 215.

The electric grid 230 is in electrical communication with one or more electricity sources. The sources may include a base power generation plant 240. Such a plant 240 may be, for example, a coal-fired electrical generation facility, a nuclear power facility, a hydroelectric damn, or combinations thereof. Electrical lines connecting the base power generation plant 240 with the electric grid 230 are represented at line 242.

The electricity sources will also include at least one renewable power generation facility 250. Such a facility 250 may be, for example, a wind farm having wind-driven turbines, or a solar power farm having an array of solar panels. Electrical lines connecting the renewable power generation facility 250 with the electric grid 230 are represented at line 252.

Most of the electricity provided by the base power generation plant 240 and the renewable power generation facility 250 is made available and delivered to other users. Other power users are shown schematically at 235. These may include residential users, small commercial users, and industrial users. Electric lines providing power from the grid 230 to other users 235 are represented at line 232. However, a part of the electricity is also used by the electrical heater 210. This is a substantial use, as considerable power is required for heating the large volumes of water needed for hot water injection.

For example, a 100,000 bbl oil/day facility may require in excess of 200,000 bbl water/day to be converted into steam at 200° C.

Where steam is created, the generated steam may be used for steam-assisted gravity drainage (SAGD). In SAGD, an injection well is completed for injecting a heated fluid such as steam. A production well for producing oil and condensate is also drilled into the formation adjacent to the injection well. The wells are also completed such that separate oil and water flowpaths in at least the near-wellbore region of the production well are ensured with appropriately throttled injection and production rates.

Steam is injected via the injection well to heat the formation. As the steam condenses and gives up its heat to the formation, viscous hydrocarbons are mobilized. The hydrocarbons then drain by gravity toward the production well. Mobilized viscous hydrocarbons are able to be recovered continuously through the production well.

Variations of SAGD processes exist. In one process, solvent is injected into a reservoir with steam. U.S. Pat. No. 6,662,872 entitled "Combined Steam and Vapor Extraction Process (SAVEX) for In Situ Bitumen and Heavy Oil Production" presents such an example. In another process, solvent in its vapor phase completely replaces the steam. U.S. Pat. No. 5,407,009 entitled "Process and Apparatus for the Recovery of Hydrocarbons From a Hydrocarbon Deposit" and U.S. Pat. No. 6,883,607 entitled "Method and Apparatus for Stimulating Heavy Oil Production" present examples.

In one embodiment of SAGD, two nearly horizontal wells are formed, with one well being located directly above the other. In this arrangement, the upper well is used to inject steam and then remove water and condensate, while the lower well is used to continuously produce the mobilized viscous oil. In another embodiment, two vertical wells are provided, with one well being the steam injection/water production well, and the other being a hydrocarbon production well. In yet a third embodiment, a horizontal well is drilled and extended below a vertical steam injection well. Steam is injected into the formation, causing the mobilization of heavy oil. Oil is then produced through the elongated horizontal well.

As alternatives to SAGD, the steam may be used for steam flooding, for cyclic steam flooding (e.g., steam soaking), or for cyclic steam stimulation (CSS). Where only hot water is created, the generated hot water may be used for water flooding to improve hydrocarbon recoveries.

A hydrocarbon solvent may be added to the first fluid stream 215 to improve recovery performance. The hydrocarbon solvent is preferably in the $C_3$ to $C_{10}$ range. In addition, the first fluid stream 215 and the second fluid stream 265 may be at least partially mixed prior to or in connection with injection. This is seen at line 272. In any instance, the result is the enhanced production of oil, shown at 254.

It is observed that the use of renewable resources for electricity supply (as shown at 250) is desirable. At the same time, renewable resources can be unreliable sources of electricity due to their fluctuating natures. For this reason, a second source of heating is needed in the heating system 200 for viscous oil reservoir 224. The heating system 200 therefore also incorporates a fired-heater, shown at 260.

The fired-heater 260 heats water to provide the second heated fluid stream. An illustrative water in-take line is shown at 262. The fired-heater 260 uses a combustible fuel for heating. A fuel in-take line is shown at 264. The fired-heater 260 may use any combustible fuel, such as natural gas or coal. To create combustion, an oxygen line is also provided at 266. The fired-heater 260 produces the heated second fluid stream 265.

Using the fired-heater 260 provides an operator with a way of matching supply and demand on the electrical grid 230. In this way, power demand can be readily adjusted to compensate for fluctuations in wind or solar electrical power being supplied to the grid 230. The fired-heater 260 is used to maintain a fairly constant generation rate of hot fluid despite fluctuations in general electrical power availability from the grid 230.

Use of the fired-heater 260 in conjunction with the electric heater 210 may enable a greater amount of renewable electrical power 252 to be supplied to the grid 230. Moreover, the ability to use fluctuating electrical power may result in being able to negotiate for the delivery of power at lower prices since the use of fluctuating or excess power enables power suppliers to more routinely generate at near peak capacity. Furthermore, the technology may permit mutually beneficial partnerships between wind and solar power producers and fluctuating power users in the oil and gas industry.

It is noted that in FIG. 2, the water in-take line 212 for the electric heater 210 and the water in-take line 262 for the fired-heater 260 are shown as separate lines. While it is true that the in-take lines 212, 262 themselves will be separate, it is preferred that the compositions of the fluids for lines 212, 262 be substantially the same. In this way, changes in heated fluid volume from one heater compared to the other will not change the composition of the combined injected fluid streams 272.

Figure 3:
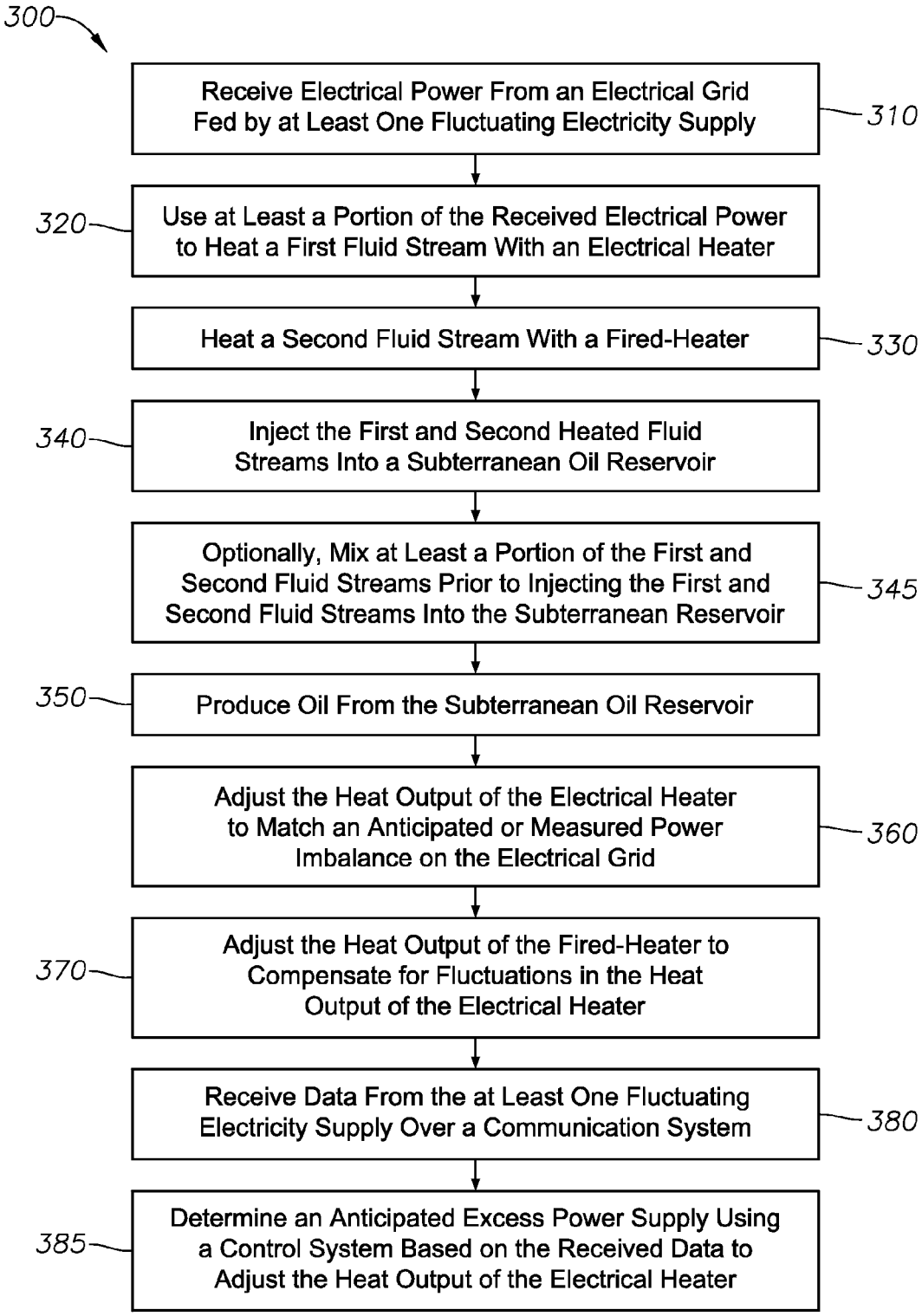
FIG. 3 is a flowchart showing steps for a method of recovering oil from a viscous oil reservoir, in one embodiment.

Using the heating facility 200, methods are provided herein for recovering viscous hydrocarbons from a subsurface formation. FIG. 3 provides methods 300 for recovering oil from a viscous subterranean oil reservoir.

As shown in the flow chart of FIG. 3, the methods 300 include receiving electrical power from an electrical grid. This is provided at Box 310. The electrical grid may be a local power grid or a regional power grid. The power grid is fed by at least one fluctuating electricity supply. The fluctuating electricity supply may be from solar electricity generation, from wind electricity generation, or both. Further technology developments may produce other renewable (but fluctuating) electricity generators.

The methods 300 also include using at least a portion of the received electrical power to heat a first fluid stream. This is seen at Box 320. The first fluid stream is heated using an electrical heater, or electrical heating unit. The electrical heater may employ, for example, resistive heating elements or conductive coils.

The methods 300 also include heating a second fluid stream. This is shown at Box 330. The second fluid stream is heated with a fired-heater. The fired heater uses a combustible fuel such as oil, gas, or coal.

In some implementations, the first fluid stream, the second fluid stream, or both comprises water. More preferably, the first fluid stream, the second fluid stream, or both comprises water that is vaporized through the heating steps of Boxes 310 and 320 into steam. Preferably, the first and second fluid streams have substantially the same fluid composition.

Additionally or alternatively, the first fluid stream, the second fluid stream, or both may comprise a hydrocarbon solvent. The solvent may be mixed with water in the heated fluid streams. Alternatively, solvent may be injected into the reservoir separate from but simultaneously with the first and second heated fluid streams.

Still additionally or alternatively, the first fluid stream, the second fluid stream, or both may comprise an asphaltic fluid. The asphaltic fluid may comprise heavy-ends produced from a solvent de-asphalting process of a viscous oil, e.g., contacting the viscous oil with propane in a vessel to cause precipitation of asphaltic components. If a market does not exist for these heavy-ends, the asphaltic fluid may be heated to reduce its viscosity, and sequestered in a subsurface formation. Such a sequestering activity may reduce the lifecycle $CO_2$ generation of viscous oil production and ultimate use. A method of using hot asphaltic fluid as a drive fluid in the recovery of hydrocarbons from a subterranean formation is disclosed in U.S. Pat. Publ. No. 2010/0155062.

The methods 300 further include injecting the heated first fluid stream or the heated second fluid stream into the subterranean oil reservoir. This is indicated at Box 340. Optionally, at least a portion of the first and second fluid streams are mixed at the surface or in a heat injection well prior to reaching the reservoir. The step of mixing the first and second heated fluids is shown at Box 345. Mixtures may be injected over time to obtain a desired fluid injection rate, a desired heat injection rate, and/or a desired temperature.

In the mixing step of Box 345, the first and second fluid streams may be directed into a common heating vessel. The heating vessel will have separate heat exchange tubes that provide heated water from the electrical heater and from the fired-heater, respectively. This would be an indirect heating method. In operation, when there is no excess power supply, or little excess electrical power available, fluid may be heated by circulating the fluid through or over heat transfer elements or tubes associated with the fired-heater. On the other hand, when there is excess power supply, fluid may be heated by circulating the fluid through or over the heat transfer elements or tubes associated with the electric heater.

If separate heating vessels are employed, the volume of fluid injected from the first fluid stream and from the second fluid stream will vary depending on the heat output from their respective heaters. Thus, when there is no excess power supply, or little excess electrical power available, less of the heated water associated with the electric heater (the first fluid stream) is injected into the reservoir, and more of the heated water associated with the fired-heater (the second fluid stream) is injected. Reciprocally, when there is excess power supply, more of the heater water associated with the electric heater (the first fluid stream) is injected into the reservoir, and less of the heated water associated with the fired-heater (the second fluid stream) is injected.

In either instance, as the two heated fluid streams contact the rock matrix or ore making up the oil reservoir, the viscous hydrocarbons are mobilized in situ. Those of ordinary skill in the art will understand that the rate of steam injection and the temperature of steam injection for a steam flooding operation may have some fluctuations so long as general target ranges are met.

The methods 300 also include producing oil from the subterranean reservoir. This is shown at Box 350. Additional production fluids may also be recovered, such as gas and water. Production takes place through one or more production wells.

In accordance with the methods 300, the heat output of the electrical heater is adjusted during production operations. Specifically, the heat output is adjusted to at least partially correspond with or match an estimated excess power supply on the electrical grid. Thus, the methods 300 further include adjusting the heat output of the electrical heater to match a measured or an anticipated power imbalance. This is seen at Box 360. A power imbalance may be deemed to be occurring based on variations in supplied voltage exceeding 0.5%, 1%, 2%, or 4% of a target voltage. That is to say, detecting or anticipating an incipient power brownout or surge. Alternatively, adjustments to heat output of the electrical heater may be performed based on small variations in supplied voltage at very short time intervals, for example based on supplied voltage averages over times on order of a second or less.

Along with adjusting the heat output of the electrical heater under the step of Box 360, the heat output of the fired-heater is also adjusted. This is provided at Box 370. Adjusting the heat output of the fired-heater serves to at least partially compensate for fluctuations in the electrical heater heat output. Thus, when excess power supply is not available, or is available in only limited amounts, the fired-heater provides greater heat output. In either event, electrical heating of the fluid is varied to utilize at least a portion of the fluctuating excess power supplied by a renewable power generation facility 250 so as to beneficially stabilize the power grid 230.

In one aspect, adjusting the electrical heater heat output (Box 360) and adjusting the fired-heater heat output (Box 370) together generate a desired temperature for a mixture of the heated first and second fluid streams.

The above methods 300 present opportunities for heat exchange that can increase the overall efficiency of a heating facility, such as facility 200. Modifications may be made to the facility 200 that are compatible with the methods 300. For example, the water from fluid in-take line 212 may be preheated with a fired heater before entering the electrical heater 210. Alternatively, the water from fluid in-take line 212 may be co-heated with a fired heater upon entering the electrical heater 210. Such a fired-heater may be, for example, a natural gas fired boiler or heat exchanger system.

Similarly, the water from fluid in-take line 262 may be pre-heated with an electrical heater before entering the fired-heater 260. Further, after heating the fluid from in-take line 362, hot flue gas from the fired-heater 260 may be recycled to preheat the air feed 266 to the fired-heater 260.

In one arrangement, the methods 300 further comprise receiving data from the at least one fluctuating electricity supply 250 over a communication system. The communication system is shown schematically by line 255 of FIG. 2. The step of receiving data from the fluctuating electricity supply 250 is shown at Box 380. The communication system 255 allows the fluid heating facility 200 to more rapidly and appropriately match fluid heating demands with the available power fluctuations.

In this arrangement, the methods 300 also include determining an estimate of excess power supply using a control system. The control system evaluates the presence of excess power supply from the fluctuating electricity sources. In response to the received data, the electrical heater heat output is adjusted. This is shown in Box 385.

In connection with estimating excess power, the operator may take into consideration a number of factors. These factors may generally be broken down into two types—real time data and projected data.

Real time data refers to a comparison of the voltage provided to the electrical grid with consumer or user demand. Voltage provided to the electrical grid, in turn, is dependent on such factors as the present output capacity of electrical generators, whether all electrical generators are operational, local wind currents, and solar intensity.

Projected data refers to trends and cycles that prevail in the operational area. For example, power consumption is generally lower at night, and increases through the day. Local temperatures may affect power consumption in very predictable ways due to their impact on home and building heating and air conditioning demands. Similarly, solar power generation is low at night, and increases through the day as solar intensity increases. Spot prices and contractual obligations for power delivery amounts will also affect the availability of electrical power. Based on these projected factors, the operator may determine periods of time for an anticipated excess power supply.

All of the above factors may be used by the operator in increasing and decreasing the heat output for the fired-heater. Optionally, the operator may choose to negotiate a reduced energy cost for periods of excess capacity.

It is noted that U.S. Pat. No. 7,484,561 issued in 2009 to PyroPhase, Inc. (as named Assignee). The '561 patent discloses the use of fluctuating power taken from an electrical grid to heat water or to generate steam for heavy oil recovery. The '561 patent is entitled "Electro Thermal In Situ Energy Storage for Intermittent Energy Sources to Recover Fuel From Hydro Carbonaceous Earth Formations." According to the '561 patent, the heating rate may be varied to compensate for the grid fluctuations so as to enable greater use of wind and solar power. In particular, it is stated:

> Hot water or steam floods are used to enhance heavy oil production. The electro-thermal energy storage method can be used to make wind and solar power effective for such deposits . . . . . For some of these California reservoirs, intermittent electrical energy could be used to heat the injection water; thereby storing the heat within the reservoir without impairing grid reliability or significantly reducing the oil recovered. The energy used for the injection water rate would have to be reduced or increased in proportion to the energy available from the variable load presented to the power line.

(col. 4, lns. 51-65).

The '561 patent teaches heating water using solely electrical means; compensating using a fired-heater is not mentioned or discussed. Use of only an electrical heater as taught in the '561 patent may be economically unappealing since the heating rate will be dependent on the availability of excess power. For viscous oil recovery from subterranean reservoirs, production rates are typically proportional to heat addition rates. Thus, intermittently adding heat may have an unacceptable economic penalty of slower-than-ideal production rates.

In contrast, the methods 300 (in its various implementations) provide for a second heated fluid stream using a fired-heater. Heat output from the fired-heater is adjusted to account for fluctuations in excess power supply. This, in turn, allows for a substantially constant volume of heated fluid for injection and formation treatment.

The use of an electrical heater that relies on a fluctuating electricity supply combined with a fired-heater has application not only for the production of viscous oil deposits, but also for heavy hydrocarbons that are recovered through open pit mining. In this regard, substantial volumes of heated fluid are required for some bitumen separation processes. For example, hot water may be used in a Clark process for separating bitumen from tar sands by forming a hot water bituminous froth. In some embodiments, hydrocarbon solvent may be used in addition to or instead of water to affect tar sands separations.

Figure 4:
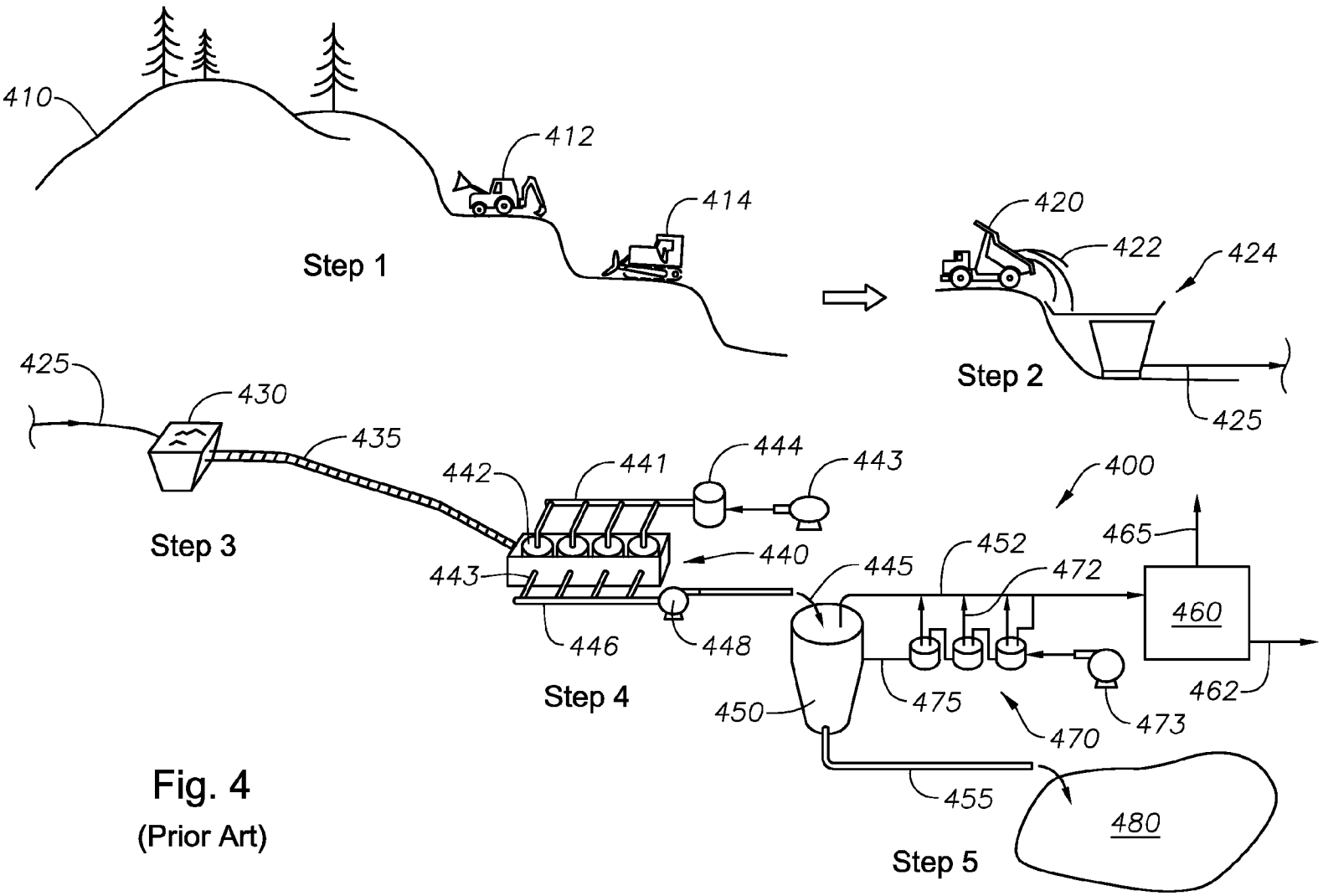
Fig. 4 (Prior Art)
FIG. 4 illustrates steps for the recovery of bitumen incident to an open-pit mining operation using a conventional CHWE process. The process is shown from mining, to slurry preparation, to bitumen separation.

FIG. 4 illustrates general steps for the recovery of bitumen incident to an open-pit mining operation. The illustrative operation uses a conventional Clark Hot Water Extraction (CHWE) process, such as described in U.S. Pat. No. 1,791,797. The CHWE process is shown in FIG. 4 from mining, to slurry preparation, to bitumen separation.

A first general step, indicated at Step 1, involves overburden removal. The overburden is shown at 410. Overburden removal typically involves the use of large earth-moving equipment such as shovels 412 and bulldozers 414.

As the overburden is removed, the rock matrix containing the viscous hydrocarbon is identified. This is referred to as ore. In the illustrative arrangement of FIG. 4, the viscous hydrocarbon or ore comprises bitumen. The bitumen-containing ore is dug using the shovels 412 and bulldozers 414. The ore is then transported for crushing. The crushing step, known as ablation, is shown in FIG. 4 at Step 2.

At Step 2, a dump truck 420 is shown unloading ore 422. The dump truck 420 unloads the ore 422 into a crushing bin 424. The crushing bin 424 utilizes hammers, bits, augers, or other mechanical tools to break the ore 422 into substantially smaller pieces. Breaking the ore 422 into smaller pieces exposes the organic material within the rock matrix, facilitating extraction. The crushed ore is then exported for storage. An export path is shown at 425.

The export path 425 may be a rail line that uses large or small cargo cars. Alternatively, the export path 425 may be a conveyor line. Alternatively still, the export path 425 may be a road over which trucks carry the crushed ore. Combinations of these export means may be used.

The export path 425 carries the crushed ore 422 to a storage bin or other gathering facility 430. It is understood that in a bitumen recovery operation, ore 422 may be brought in from more than one area of open pit mining. Therefore, a central gathering facility 430 for crushed ore may be employed. The process of gathering crushed ore is provided in FIG. 4 as Step 3.

In the process of FIG. 4, the crushed ore is converted to a slurry. To do this, the crushed ore is moved from the gathering facility 430 onto a conveyor path 435. The conveyor path 435 is preferably a conveyor line. However, the conveyor path 435 may be a rail line or a road over which trucks carry the crushed ore.

In any instance, the crushed ore is taken to a slurry preparation area 440. The slurry preparation area 440 combines an aqueous fluid such as fresh water with the crushed ore. This is seen at Step 4. The slurry preparation area 440 may have a series of vats 442 in which heated water is mixed with the crushed ore to form a bituminous slurry. The slurry exits the vats 442 through one or more slurry lines 443.

As part of the slurry preparation of Step 4, a chemical may be added to the water and ore material. The additive may be a surfactant, or a process aide that releases natural surfactants from the ore. The surfactant helps to separate the viscous hydrocarbon from the surface of the rock matrix. An example of a process aide that releases natural surfactants from the ore is caustic soda.

Other detergents or dispersants may alternatively be used. For example, a solvent-based cleaner may be employed. The solvent breaks up the oil while cleaning it off of the rock particles.

The chemical additive is stored in chemical tank 444. The chemical additive is delivered to the vats 442 through chemical lines 441. In addition to the chemical additive in tank 444, in a conventional CHWE process, air is added. A compressor is shown at 443 for adding air to the slurry. In the arrangement of FIG. 4, the compressor 443 is shown adding air to the chemical additive. In this way, the chemical additive and air are pre-mixed. However, the air may be injected into the vats 442 directly.

It is noted that air and bitumen are both hydrophobic. As a result, surface energy is minimized by combining air with bitumen. This combination phase separates from water. Since bitumen is of similar density to water, the air also serves to reduce the density of the combined air and bitumen, enabling the bitumen to float on water. The bitumen may then be skimmed or otherwise separated from water in a large settling vessel.

In the CHWE process, air, bitumen, and water are mixed with mild heat. For example, the slurry may be heated in the vats 442 to 30° to 60° C. The heat allows the bitumen to become more flowable and forms the hot water bituminous froth.

Once the slurry is prepared and heated in the vats 442, the slurry is delivered to the extraction facility 400 through slurry lines 442 and into a hydro-transport line 446. Additional air is typically added in the hydro-transport line 446. A second compressor is seen at 448. Adding air to the slurry in the hydro-transport line 446 facilitates the mixing of water and chemical additive (if any) with the ore. This, in turn, helps expose the bitumen.

The slurry is delivered to a primary separation vessel 450. Slurry is shown entering the separation vessel 450 at 445. Gravitational separation then takes place in the primary separation vessel 450. Oil and sand generally fall to the bottom of the vessel 450 and are carried away through a primary sand slurry line 455. At the same time, oil, solvent, and other chemicals are skimmed off of the top and are carried away through an oil line 452. The oil in line 452 is taken to a de-aeration vessel 460 for the removal of air. Air is released through line 465, while oil is taken through a bottom stream 462.

Typically, some additional separation of the oil from oil line 452 is carried out. In the arrangement of FIG. 4, a series of flotation cells 470 is provided. Air may be added to the flotation cells 470 using compressor 473. The air helps break oil out of the water and sand. At each cell 470, oil and air are carried away through upper lines 472. A second sand slurry is then released back into the primary separation vessel 450 through line 475.

As noted, a primary sand slurry line 455 removes sand and water from the primary separation vessel 450. The sand slurry is delivered to a tailings pond 480 for settling. The sand slurry, or "tailings," is allowed to settle in the pond 480. Eventually, solid mineral materials are returned to the overburden 410 as part of a reclamation project.

The operator has the option of conducting further separation operations to recapture the water from the sand and purify the water. For example, a hydrocyclone or a mesh could be used to strain sands and fines from the aqueous sand slurry in line 455. From there, conventional methods for treating produced water to remove contaminants may optionally be used.

The Clark Hot Water Extraction process, in combination with floatation cells 470, is efficient for extracting about 90% of the bitumen from high grade ores. In some instances, and depending on the number of flotation cells 470 used, the percentage may be even higher.

Figure 5:
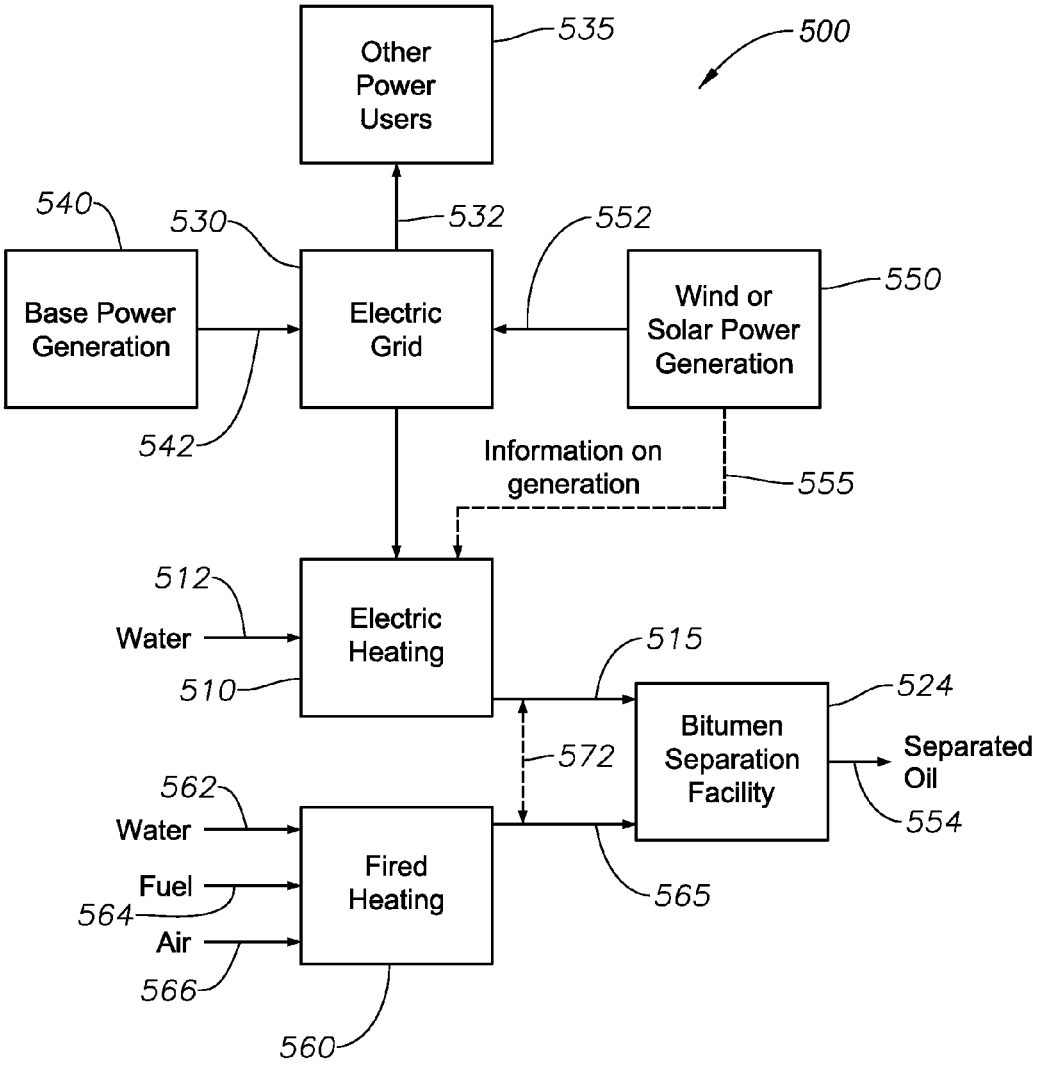
FIG. 5 is a second schematic diagram of a fluid heating facility. The fluid heating facility includes an electrical heating unit and a fired-heater heating unit. Heated fluid is being transported from the heating units into a bitumen separation facility.

FIG. 5 is a second schematic diagram of a fluid heating facility 500. Here, the fluid heating facility 500 is for a bitumen separation facility. The fluid separation facility 500 again includes an electrical heating unit and a fired-heater heating unit. Heated fluid is being transported from the heating units into a bitumen separation facility. The bitumen separation facility is shown at 524, and is indicative of the slurry preparation area 440 shown in FIG. 4.

The diagram for the heating facility 500 of FIG. 5 is similar to the diagram for the heating facility 200 of FIG. 2. In this respect, two heated fluid streams are once again generated. The heated fluid streams are shown at lines 515 and 565. The fluid streams 515, 565 may optionally be carried through one or more pumps, and are then injected into the slurry vats 442. In one arrangement, the fluid streams 515, 565 are combined into common pressure vessels for pressurizing and delivery into the slurry vats 442. In another arrangement, heated liquid from the fluid streams 515, 565 is temporarily stored in insulated surface tanks (not shown) prior to injection into the slurry vats 442.

In a preferred embodiment, each fluid stream 515, 565 comprises primarily hot water. The water may be either fresh water or brine. However, either or both of the fluid streams 515, 565 may also comprise a hydrocarbon solvent to further reduce the in situ oil viscosity. The hydrocarbon solvent preferably has components within the $C_3$ to $C_{10}$ range.

In order to heat the fluid streams 515, 565, heating units are provided. These again represent an electrical heater 510 and a fired-heater 560. A representative water stream 512 is shown feeding into the electrical heater 510. Similarly, a representative water stream 562 is shown feeding into the fired-heater 560, along with a fuel line 564 and an air line 566.

The electrical heater 510 and the fired-heater 560 generally operate in accordance with the electrical heater 210 and the fired-heater 260 for the heating facility 200. In this respect, the electrical heater 510 receive electrical power from an electric grid 530.

The electric grid 530 receives electricity from a base power generation facility 540 and a fluctuating, renewable power generation facility 550. Power facilities 540 and 550 are in accordance with power facilities 240 and 250 of FIG. 2. Therefore, the discussion concerning the electric grid 530, the base power generation plant 540, the at least one fluctuating, renewable power generation facility 550, the other power users 535, and lines 532, 542, and 552 will not be repeated. Further, the discussion of the communication system shown schematically by line 555 need not be repeated.

The heating facility 500 is used to heat water (or other fluid) for the separation of bitumen from tar sands. FIG. 5 demonstrates the flow of the first heated fluid stream 515 and the second heated fluid stream 565 into a bitumen separation facility. Specifically, the heated fluid streams flow into the vats 442 for creating the bituminous slurry. Optionally, the heated fluid streams 515, 565 have the same physical composition, and may even be heated together as the same fluid volume. Line 572 is dashed to indicate optional mixing or combining before entry into the bitumen separation facility 524.

The end result for the heating facility 500, as discussed in connection with FIG. 4 above, is the generation of separated oil. Line 554 of FIG. 5 illustrates the production of separated oil. This is in accordance with bottom stream 462 of FIG. 4.

As discussed above, using the fired-heater 560 provides an operator with a way of matching supply and demand on the electrical grid 530. In this way, power demand can be readily adjusted to compensate for fluctuations in wind or solar electrical power being supplied to the grid 530. The fired-heater 560 is used to maintain a fairly constant generation rate of hot fluid, despite fluctuations in general electrical power availability from the grid 530 for the electric heater 510.

Figure 6:
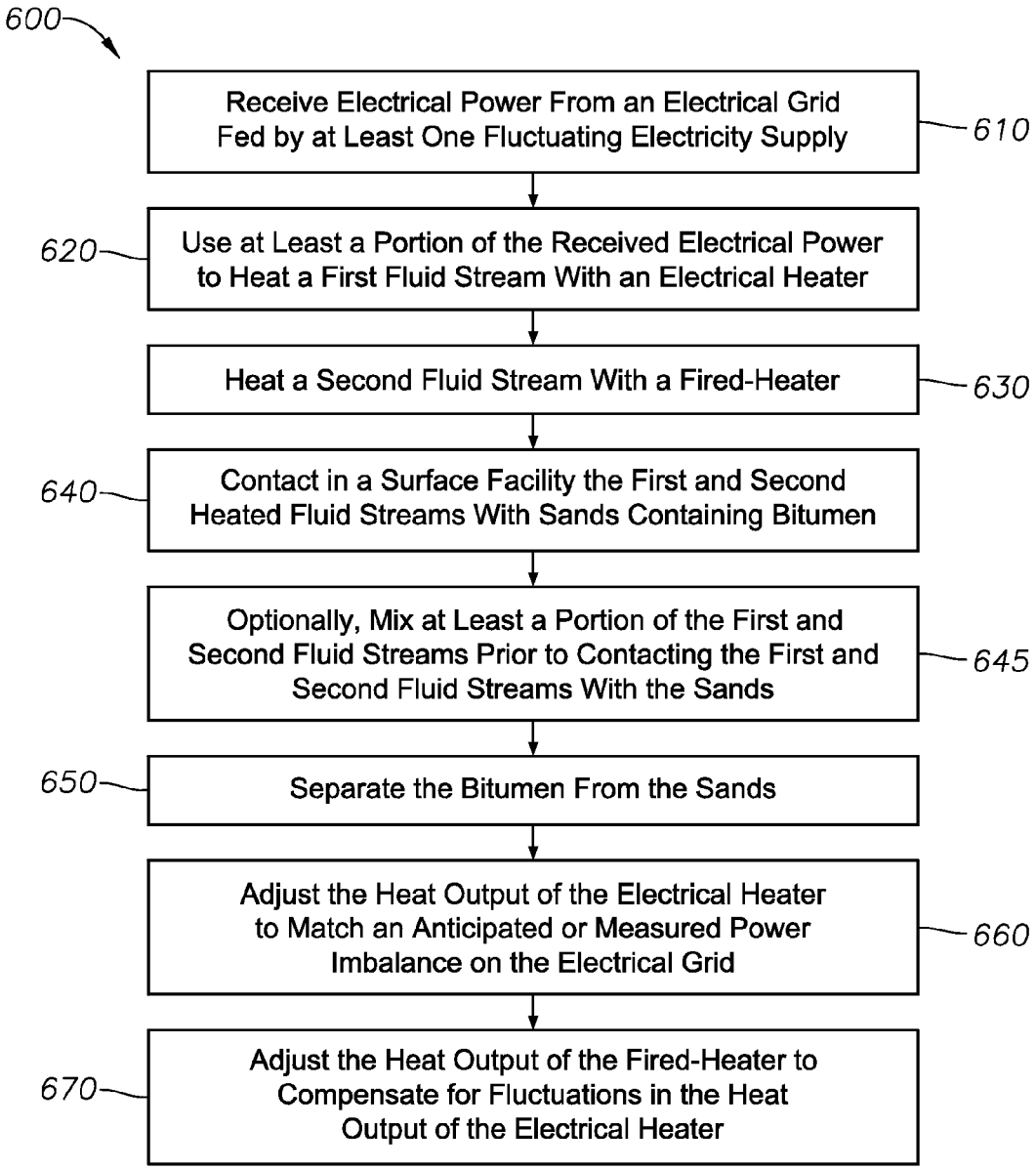
FIG. 6 is a flowchart showing steps for a method of separating bitumen from sands in a surface facility, in one embodiment.

FIG. 6 is a flowchart showing steps for methods 600 of separating bitumen from sands in a surface facility. As with methods 300, the methods 600 also involve an adjustment of heat output based on the availability of excess power supply from a power grid.

As shown in the flow chart of FIG. 6, the methods 600 include receiving electrical power from an electrical grid. This is provided at Box 610. The electrical grid may be a local power grid or a regional power grid. The power grid is fed by at least one fluctuating electricity supply. The fluctuating electricity supply may be from solar electricity generation, from wind electricity generation, or both. Future technology developments may reveal other fluctuating energy sources.

The methods 600 also include using at least a portion of the received electrical power to heat a first fluid stream. This is seen at Box 620. The first fluid stream is heated using an electrical heater, or electrical heating unit. The electrical heater may employ, for example, resistive heating elements or conductive coils.

The methods 600 also include heating a second fluid stream. This is shown at Box 630. The second fluid stream is heated with a fired-heater. The fired heater uses a combustible fuel such as oil, gas, or coal.

In some implementations, the first fluid stream, the second fluid stream, or both comprises water. Preferably, the first and second fluid streams have substantially the same fluid composition. The composition may include a surfactant or a process aide.

Additionally or alternatively, the first fluid stream, the second fluid stream, or both comprises a hydrocarbon solvent. The solvent may optionally be used to dilute water in the fluid streams. Alternatively, solvent may be injected into the reservoir separate from but simultaneously with the first or second heated fluid streams.

The methods 600 further include contacting in the surface facility the first and second heated fluid streams with sands containing bitumen. This is shown in Box 640. The contacting may be separate fluid streams, or mixtures thereof over time. Optionally, at least a portion of the first and second fluid streams are mixed prior to contacting the sands. This is indicated at Box 645. The bitumen is then separated from the sands using any known separation technique. This is seen at Box 650. Separation techniques may involve gravity separation, centrifugal separation, heating, filtering, flotation cells, or combinations thereof. The separated hydrocarbonaceous material is then captured for further processing and sale.

The methods 600 also include adjusting the heat output of the electrical heater. This is provided at Box 660. The heat output is adjusted to at least partially match an estimated excess power supply on the electrical grid. At the same time, the heat output of the fired-heater is adjusted to at least partially compensate for fluctuations in the electrical heater heat output. This is shown at Box 670. Thus, when excess power supply is not available, or is available in only limited amounts, the fired-heater provides greater heat output.

In one aspect, adjusting the electrical heater heat output and adjusting the fired-heater heat output together generate a desired temperature for a mixture of the first and second heated fluid streams. In this instance, the relative volumes of heated fluid from the first and second fluid streams will vary depending on the heat output from their respective heaters. Thus, when there is no excess power supply, or little excess electrical power available, most if not all of the heat for heating fluid is generated by the fired-heater. Reciprocally, when there is excess power supply, more of the heat output for heating fluid is generated by the electrical heater.

In some implementations, the first fluid stream, the second fluid stream, or both comprises water. Preferably, the first and second fluid streams have substantially the same fluid composition. Where the first and second fluid streams are mixed, the operator may choose to heat the fluid streams together in a single heating vessel. In this instance, heating may be provided through indirect contact and using separate heat exchange tubes. One set of tubes is associated with the electrical heater, while the other set of tubes is associated with the fired-heater.

Additionally or alternatively, the first fluid stream, the second fluid stream, or both comprises a hydrocarbon solvent. The solvent may optionally be used to dilute water in the fluid streams. Alternatively, solvent may be injected into a slurry contactor separate from but simultaneously with the first and second heated fluid streams.

It is also noted that the use of light hydrocarbon solvents may provide some degree of in situ upgrading of the heavy oil. Solvents may precipitate out a portion of low-value asphaltene components in certain viscous oils.

Each of the methods 300 and 600 offers the use of excess renewable electric power to aid viscous oil recovery. This has the benefit of reducing the $CO_2$ footprint of the recovery operations over that of using solely a fired-heater. Moreover, the current inventions may reduce total energy costs for viscous oil recovery if the electrical power can be bought at lower prices. Lower prices may be available since otherwise power generators would need to be turned off or throttled to match electricity demand. Furthermore, each of the methods 300 and 600 offers a way to enable putting additional renewable energy sources, such as wind and solar power, onto an electrical grid while still maintaining uniform delivery voltages.

If a fired-heating system was not included, injection rates for the heated fluid streams would need to be varied in response to the availability of excess power on the grid. This is economically undesirable. In connection with the method 300, viscous oil recovery, especially when steam is required, is generally directly proportional to the amount of heat energy injected into the reservoir. If the hot fluid injection is on average reduced, the oil production rates on average are reduced. Significant excess electrical power may be available only infrequently, very likely less than about 50% of the time, or perhaps even less than 30% of the time. Stretching out the production time for a reservoir is unappealing economically due to the time-value-of-money and due to needing to significantly oversize production and processing equipment to meet peak needs. Moreover, thermal energy losses (via thermal diffusion) to the overburden and underburden of the reservoir increase with required production time. These losses can be quite significant for thin reservoirs (such as organic-rich rock intervals of less than 15 meters) or over long periods of time (such as greater than 5 years).

Figure 7:
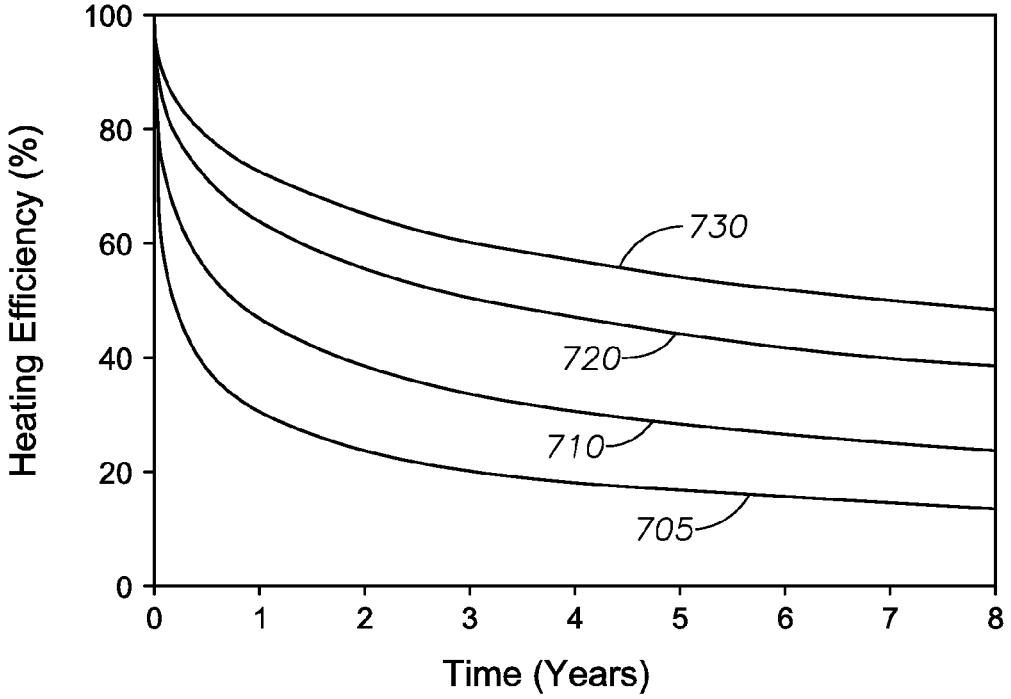
FIG. 7 is a chart comparing heating efficiency in a subterranean oil reservoir over time. Four different modeled formation thicknesses are shown.

FIG. 7 is a graph 700 that plots modeled heating efficiency of a slab-like formation as a function of time and formation thickness. Efficiency is reduced as heat conductively migrates outside of the formation to the overburden and underburden. Heat energy losses are provided in terms of heating efficiency in the y-axis, while time is shown in years on the x-axis. Four different lines are shown in graph 700. These represent four different modeled zone thicknesses. Thicknesses are shown for 5 meters (16.4 feet) (705), 10 meters (32.8 feet) (710), 20 meters (65.6 feet) (720), and 30 meters (98.4 feet) (730).

It can be seen from FIG. 7 that heating efficiency is lower for the thinnest interval (zone 705) than for the thickest interval (zone 730) since heat inside the thinnest interval has less distance to conductively travel to migrate outside the interval. Further, for each zone thickness (zones 705, 710, 720, 730), heating efficiency is reduced over time. The efficiency reduction represents heating losses due to intervals of shut-down for the electric heater in the absence of a supplemental fired-heater. Assuming a typical thermal diffusivity of 0.07 $m^2$/day, the heating losses reduce the useful heat placed within the reservoir and thus further reduce the oil production rates. Thus, putting a fixed amount of heat into an interval spread out over a longer time period is less efficient than putting the same amount of heat in over a shorter time but at a faster rate. For these reasons, supplementing the fluctuating electrical heating with fired-heating is highly desirable so as to maintain a targeted heat injection rate.

In one aspect of the methods 300, 600, heat input to the reservoir may be maximized as a function of time. The optimization process may be based on a number of factors. These include (i) electricity cost, (ii) heating fuel cost, (iii) $CO_2$ tax credits, (iv) $CO_2$ emission penalties, (v) energy loss to an adjacent stratum, (vi) time-value of money of delayed production, or (vii) combinations thereof.

While it will be apparent that the inventions herein described are well calculated to achieve the benefits and advantages set forth above, it will be appreciated that the inventions are susceptible to modification, variation and change without departing from the spirit thereof. For example, the methods disclosed herein allow for the use of excess power supply created from fluctuations electricity.

What is claimed is:

1. A method of recovering oil from a viscous oil reservoir, the method comprising:

receiving electrical power from an electrical grid which is fed by at least one fluctuating electricity supply;

generating steam by heating water within a first fluid stream with an electrical heater that is powered by at least a portion of the received electrical power;

adjusting a heat output from the electrical heater to at least partially correspond with an estimated excess power supply on the electrical grid;

generating steam by heating water within a second fluid stream with fired-heater;

adjusting a heat output from the fired-heater to at least partially compensate for fluctuations in the electrical heater heat output;

injecting the steam generated from the first fluid stream, the second fluid stream, or mixtures thereof over time into a viscous oil reservoir to mobilize the viscous oil; and producing mobilized oil from the viscous oil reservoir;

wherein the fired-heater and the electrical heater are within a common vessel in a surface facility.

2. The method of claim 1, wherein the viscous oil comprises primarily bitumen.

3. The method of claim 1, wherein the viscous oil has a viscosity greater than about 1,000 cp in its undisturbed in situ state.

4. The method of claim 1, wherein the at least one fluctuating electricity supply comprises (i) solar electricity generation, (ii) wind electricity generation, or (iii) both.

5. The method of claim 1, wherein the first fluid stream and the second fluid stream are the same physical stream.

6. The method of claim 1, wherein adjusting the electrical heater heat output and adjusting the fired-heater heat output is performed to maintain a targeted heat transfer rate to the viscous oil.

7. The method of claim 6, further comprising:

preheating the second fluid stream with an electrical heater before heating the second fluid stream with the fired-heater.

8. The method of claim 6, further comprising:

preheating the first fluid stream with a fired-heater before heating the first fluid stream with the electrical heater.

9. The method of claim 1, wherein using the electrical heater comprises heating the first fluid stream with one or more electrically resistive heating elements or one or more fluid tubes.

* * * * *